US006165317A

United States Patent [19]

Sabourin

[11] Patent Number: 6,165,317

[45] **Date of Patent: *Dec. 26, 2000**

[54] CONTROL OF REFINED PULP QUALITY BY ADJUSTING HIGH TEMPERATURE PRE-HEAT RESIDENCE TIME

[75] Inventor: Marc J. Sabourin, Huber Heights, Ohio

[73] Assignee: Andritz Sprout-Bauer, Inc., Muncy, Pa.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/108,651

[22] Filed: Jul. 1, 1998

Related U.S. Application Data

[63] Continuation of application No. 08/489,332, Jun. 12, 1995, abandoned.

[51] Int. Cl.[7] ..... D21B 1/14

[52] U.S. Cl. ..... 162/23; 162/28; 162/68; 241/28; 241/29

[58] Field of Search ..... 162/21, 23, 28, 162/63, 68; 241/28, 29

[56] References Cited

U.S. PATENT DOCUMENTS

| | | | |
|---|---|---|---|
| 2,145,851 | 2/1939 | Asplund | 92/6 |
| 2,323,194 | 6/1943 | Beveridge et al. | 92/6 |
| 2,396,587 | 3/1946 | Lowgren et al. | 92/7 |
| 2,972,171 | 2/1961 | Heritage | 19/72 |
| 3,338,525 | 8/1967 | Asplund et al. | 241/17 |
| 3,446,699 | 5/1969 | Asplund et al. | 241/18 |
| 3,661,328 | 5/1972 | Leask | 241/18 |
| 3,765,611 | 10/1973 | Steiniger | 241/15 |
| 3,910,505 | 10/1975 | Reinhall | 241/18 |
| 4,136,831 | 1/1979 | Cederquist et al. | 241/17 |
| 4,372,495 | 2/1983 | Marton et al. | 241/28 |

FOREIGN PATENT DOCUMENTS

| | | | |
|---|---|---|---|
| 0 609 542 A1 | 12/1993 | European Pat. Off. | D21B 1/12 |
| 0 609 542 A1 | 10/1994 | European Pat. Off. . | |
| 89610 | 3/1993 | Finland . | |
| 2356763 | 6/1977 | France . | |
| WO 91/12367 | 8/1991 | WIPO . | |
| WO94/16139 | 7/1994 | WIPO . | |
| WO 95/34711 | 12/1995 | WIPO . | |

OTHER PUBLICATIONS

Lunan, W.E. "High Pressure . . . Pulping", 1983 Pulping Conference, pp. 239–253.

Sundholm, J. "Can we . . . Mechanical Pulping", 1993. International Mechanical Pulping Conference (1993) Oslo, Norway, "Can We Reduce Energy Consumption in Mechanical Pulping", by Jan Sundholm, pp. 133–142.

Finnish patent No. 89610 (based on application 914397).

English translation of specification of Finnish Patent 89610.

PCT International Search Report—Nov. 21, 1996.

PCT International Application WO94/16139, published Jul. 21, 1994.

PCT International Application WO91/12367, published Aug. 22, 1991.

(List continued on next page.)

*Primary Examiner*—Dean T. Nguyen

*Attorney, Agent, or Firm*—Alix, Yale & Ristas, LLP

[57] ABSTRACT

A method for refining lignocellulose-containing material into pulp in a disc refiner comprises preheating the material to a temperature greater than the glass transition temperature of lignin in the material, and holding this temperature for under one minute. The heated material is then subject to high speed refining in a disc refiner to produce pulp. The resulting pulp may then be subject to secondary refining steps to produce paper quality pulp. The preheat retention time is preferably in the range of 5–30 seconds, and can be controlled as a process variable to optimize energy savings, pulp strength, and optical qualities. High quality pulp can be obtained with preheat at high temperature and low retention time, followed by primary refining at disc speed of at least 2300 rpm.

15 Claims, 7 Drawing Sheets

OTHER PUBLICATIONS

PCT International Application WO89/10998, published Nov. 16, 1989.

"Refining Intensity and Pulp Quality in High–Consistency Refining", K. Miles, "Paper and Timber" 72(1990):5.

"A Simplified Method for Calculating the Residence Time and Refining Intensity in a Chip Refiner:—K.B. Miles, Paper and Timber" 73(1991):9.

High Pressure Refining and Brightening in Thermomechanical Pulping, W.E. Lunan et al, 1983 Pulping Conference, p. 239.

CONTROL OF REFINED PULP QUALITY BY ADJUSTING HIGH TEMPERATURE PRE-HEAT RESIDENCE TIME

This is a continuation of application Ser. No. 08/489,332, filed Jun. 12, 1995, now abandoned.

BACKGROUND OF THE INVENTION

The present invention is related to the field of pulp production, more particularly the invention relates to the field of refining wood chips into pulp for paper manufacturing.

Single and double disc refiners are well-known in the art of pulp production. Such refiners are typically employed in the production of pulp from lignocellulose-containing fiber material, in a two-step process having primary and secondary refining. In a thermomechanical pulping (TMP) process, wood chips are fed into a pressurized pre-heater by a first plug screw feeder or first rotary valve and preheated with steam. A second screw conveyor or second plug screw feeder then discharges the chips from the pre-heater. A ribbon or other feeder then moves the preheated chips into a refiner for initial refining into pulp. Should a plug screw feeder be used for the second feeder, the system pressures in the pre-heater and refiner can be decoupled. The pulp from the primary refiner is then introduced into a secondary refiner for further processing.

Refiners have conventionally been operated at pressures of approximately 30–55 psi (207–345 kPa) and speeds of 1500 to 1800 rpm for single disc refiners end 1200 to 1500 rpm for double disc refiners. To produce pulp of desired quality, the wood chips are mixed with steam and retained in the pre-heater at a predetermined temperature and pressure prior to primary refining. The time of retention, or residence time, directly effects pulp quality. Residence time is the time the chips are maintained between the first plug screw feeder and the refiner feeder. In a decoupled system, a residence interval exists in the pre-heater and also from the second discharge plug screw feeder to the refiner feeder. Each of these two residence intervals can be regulated at a different pressure. The conveying and refining time for the chips to be moved by the refiner feeder into the refiner and through the refiner discs is not factored into the residence time. The reason is the short duration of the conveying and refining time. For most refiners, the conveying and refining time is less than one second.

An important factor in the competitiveness of disc refiners with other methods of pulp refining is the energy consumption necessary to operate the disc apparatus. Rapid increases in energy cost can render disc refiners non-competitive against other forms of pulp production from an economic standpoint. It is known in the art that increasing the operational speed of a refiner reduces the total specific energy requirements for production of somewhat similar quality pulp. High speed operation in a conventional single disc refiner is greater than 1800 rpm and typically at a range of approximately 2300 to 2600 rpm. For a double disc refiner, high speed operation is over 1500 rpm and typically at the range of 1800–2400 rpm. The higher rpm in the refiner results in what is defined as high intensity refining. Refining intensity can be expressed as either the average specific energy per bar impact or as the specific refining power. For further detailed definitions of high intensity refining, reference is made to "A Simplified Method for Calculating the Residence Time and Refining Intensity In a Chip Refiner", K. B. Miles, *Paper and Timber* 73(1991):9. Increasing the rotational speed of a refiner disc results in increased intensities of impacts of chips with the bars on the grinding face of the disc refiner. However, high speed refining can have the undesirable side effect of producing pulp that when further processed results in lower strength paper.

Another way of reducing energy costs in the entire paper production system is by high pressure steam recovery from the chip preheating. In conventional TMP systems, some mills require a thermocompressor or a mechanical compressor to boost the pressure of recovered preheat steam to a level necessary to supply a process demand elsewhere in the mill. Operation of the pre-heater at high pressure results in steam of sufficient enthalpy such that the recovered preheat steam may be directly employed in a given process or economically stepped down to a level necessary to meet a process demand.

The pressure on the chips during the preheating affects pulp quality. It is important to note that high pressure and high temperature are synonymous in refining because the two variables are directly related. An important factor in refining is the temperature of the wood chips prior to primary refining in relation to the glass transition temperature of the chip lignin ($T_g$). This temperature varies depending on the species of the chip source.

Preheating at high temperatures, i.e., greater than the glass transition point with a conventional residence time softens the lignin to such an extent that the fiber is almost completely separated. The fibers separated under these high temperatures or pressures are largely undamaged, and they are coated with a thin layer of lignin which makes any attempt to fibrillate very difficult. The result la higher specific energy requirements and reduced optical properties of paper produced from the pulp.

Prior attempts have been made to reduce energy consumption by use of higher speed refiners and by manipulating chip and pulp temperatures above and below $T_g$. PCT application WO 94/16139 discloses a low energy consumption process wherein material is fed into a primary refiner at conventional conditions of pressure. The refined pulp is then second stage refined at a temperature well above the glass transition temperature of lignin.

SUMMARY OF THE INVENTION

The invention is a new and improved method of refining pulp at the primary disc refiner in a pulp production system having one or more refiners, The method reduces energy requirements while at the same time maintaining or improving the quality of pulp as a result of employment of the novel method.

The method of the invention incorporates refining pulp at high intensity but significantly reducing the total specific energy requirement with no loss in pulp strength or optical properties. This result is obtained by heating the wood chips to a temperature greater than $T_g$ with residence time less than 30 seconds, immediately prior to primary refining. In particular, it is desirable to hold the chip temperature at least 20° C. above $T_g$ for a particular species of wood chip. The chips are then fed into a high intensity refiner. This method results in at least a 10% reduction in specific energy over conventional TMP.

In general, the residence time (R), pressure (T), speed (S) window for a particular wood species to produce improved TMP quality versus conventional TMP quality is 5–40 s residence time, 75–95 psi pressure and a refiner speed greater than 1800 rpm for a single disc refiner and greater than 1500 rpm for a double disc refiner. In spruce/balsam chips for example, the optimum RTS window is obtained by operating a single disc refiner at 2600 rpm at a pressure of 85 psi with a residence time between 5 and 30 seconds. The RTS-TMP method of the invention allows sufficient thermal softening to permit a high level of fiber development at high intensity refining but with a reduced energy expenditure.

The preheat retention time can be used as a control variable to optimize the trade off among energy savings, strength properties, and optical properties.

According to a more specific aspect of the invention, a novel method is provided, in which pulp quality is actually improved by operating at higher refiner disc speed. With this method, high speed is used an a mechanism to improve fiber quality, and previous adverse effects of operating at higher intensity levels are not observed.

In the preferred implementation, the method incorporates refining at high speed, but significantly improves pulp quality at a given level of energy applied to the fiber. The residence time is in the range of 5–30 seconds with the chip temperature at least 20° C. above $T_g$. The chips are then fed to a high speed refiner. This method results in an improved level of fiber development, shive reduction, and bleachability.

The high quality pulp of the RTS-TMP method allows use of a greater variety of secondary refiners. Some secondary refiners can allow additional energy savings, or others may be employed to produce particular kinds of paper.

The RTS-TMP method of the invention also has uses in chemical thermal mechanical pulping (CTMP) and alkaline peroxide thermal mechanical pulping (AP-TMP). In these applications (CTMP, AP-TMP) the recommended operating pressures are reduced to 35 psi to 60 psi due to a large drop in the glass transition temperature of wood lignin.

Therefore, it is an object of the invention to provide a method of refining pulp that reduces the energy requirements for achieving a given fiber quality.

It is another object of the invention to provide a method of pulp production that produces higher pulp quality at a lower energy consumption then conventional TMP techniques. In particular, pulp quality is improved at a given application of specific energy.

It is yet another object of the invention to provide a method of producing improved pulp at the primary refiner to allow a greater number of options in the choice of secondary refining methods.

It is a further object of the invention to provide a method of producing improved pulp at the primary refiner to allow use of a secondary refiner having reduced energy requirements.

It is still another object of the invention to provide a method of producing pulp that requires a reduced amount of equipment.

Another object is to produce chips more receptive to initial defibrization at high intensity.

A further object is to provide an improved TMP method of refining fiber to produce so-called market pulp, suitable for making printing and writing grades of paper.

These and other objects of the invention are disclosed in the following description.

BRIEF DESCRIPTION OF THE DRAWINGS

Other advantages of the invention will become more readily apparent by reference to the following drawings and description wherein.

DETAILED DESCRIPTION OF THE PREFERRED EMBODIMENT

Figure 1:
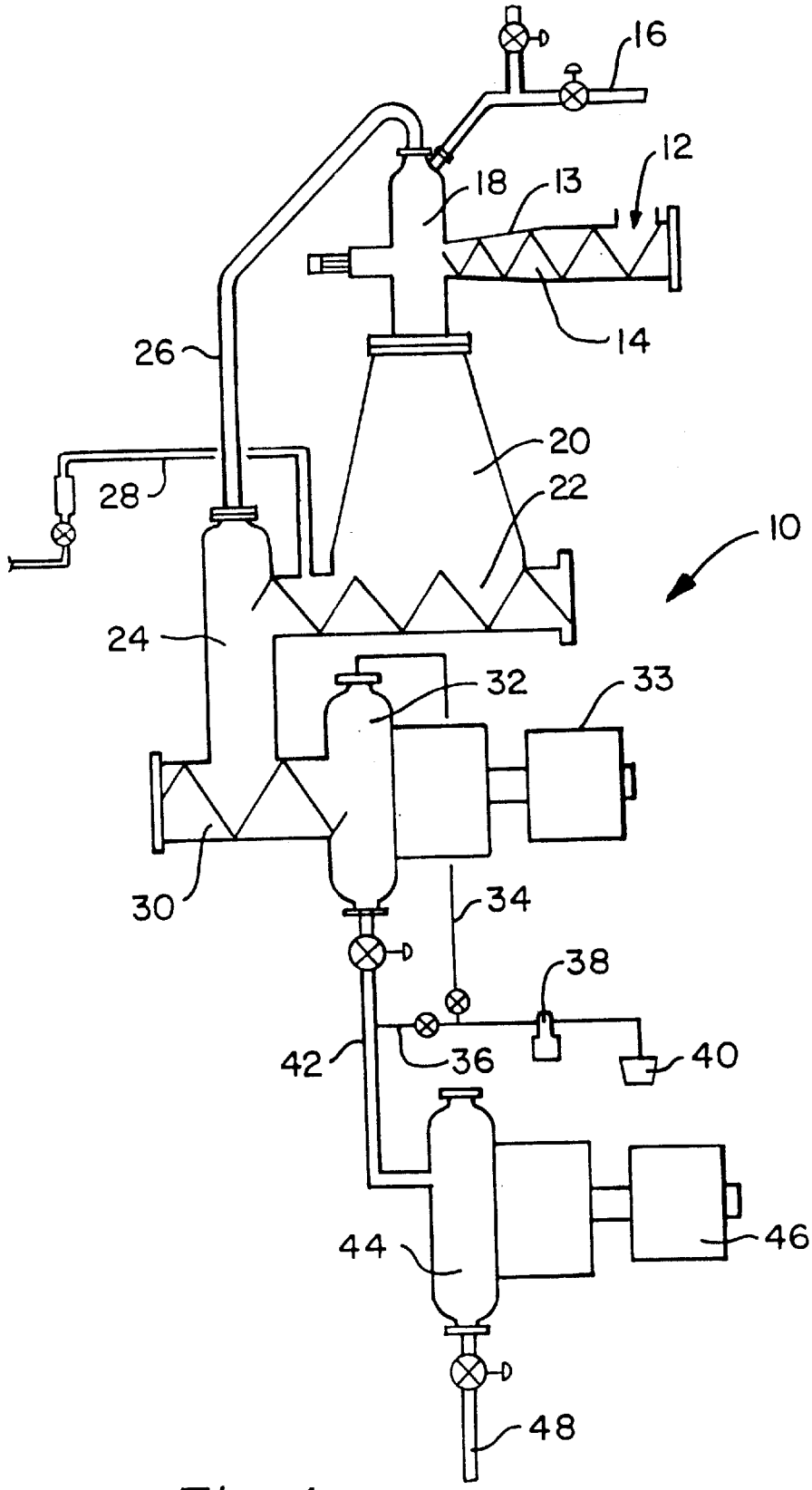
FIG. 1 is a schematic diagram of a two-refiner system capable of employing the RTS-TMP method of the invention.

In FIG. 1, a refining system capable of employing the RTS-TMP method of the invention is generally designated by the numeral 10. The dual refiner system 10 operates by an introduction of wood chips at a plug screw inlet port 12. A plug screw 14 drives the chips into the refining system 10 by rotating in a plug screw housing 13. A rotary valve may be substituted for plug screw 14 in some systems. Steam to heat the chips is introduced to the refiner system by line 16. The steam and chips mix in chamber 18 and enter the pre-heater 20. The heated chips are moved vertically by the inherent force of gravity to a discharge screw 22. The discharge screw 22 rotates to move the heated chips into the steam separation chamber 24. Steam is returned from the steam separation chamber to chamber 18 by means of line 26. Water or other treatment chemicals may be added to the mixture at line 28. The heat treated wood chips are then driven by a high speed ribbon feeder 30 into the primary refiner 32. The primary refiner 32 is driven by motor 33. The conveying and refining time of the chips in the ribbon feeder 30 and the refiner 32 is less than 1 second. Bleaching agents can be introduced into the pulp at the primary refiner 32 through lines 34 and 38 by metering system 38 from bleaching agent reservoir 40.

The primary pulp is directly fed through blow line 42 to the secondary refiner 44, the refiner being driven by motor 46. The refined pulp of the secondary refiner 44 is transferred by line 48 to other apparatus for further processing into a final product.

The residence time is the travel time for the chips to be moved between the plug screw feeder 14 and the ribbon feeder 30. In a decoupled system, a plug screw feeder would replace the discharge screw 22. The residence time at high pressure would then be defined as the duration between screw 22 and the ribbon feeder 30. With this alternative of the RTS-TMP invention, a preheating vessel is not necessary. A pressurized variable speed transfer conveyor 22 between the plug screw feeder and ribbon feeder is recommended to allow control of the residence time prior to refining. In a typical conventional refining method, the residence time of the chips between the plug screw feeder to primary refining is not a controlled variable and the pressure is typically at least 25 psi lower than the RTS conditions. The lower refining pressures of conventional TMP result in the glass transition temperature of lignin in the wood chips near or less than $T_g$, which in turn prevents excessive softening of the lignin in the wood chips. This prevents a high degree of separation at the middle lamella, which would otherwise result in a high degree of separated fibers coated in a layer of lignin which renders very difficult any attempt to fibrillate the fiber structure.

High pressure refining may be desirable to allow economical steam recovery for further uses in process demand. The results of a comparison of conventional TMP, and TMP at high pressure are shown below.

TABLE 1

EFFECT OF PRESSURE AT 1800 RPM

| | Conventional TMP | High Pressure TMP |
|---|---|---|
| PRIMARY | | |
| RPM | 1800 | 1800 |
| Pressure (kPa) | 278 | 586 |
| Residence Time (Seconds) | 150 | 150 |
| Specific Energy (kWh/ODMT) | 705 | 505 |
| SECONDARY PULP | | |
| Total Specific Energy (kWh/ODMT) | 1838 | 2185 |
| Freeness (ml) | 194 | 179 |
| Bulk | 3.04 | 2.73 |
| Burst | 1.7 | 2.1 |
| Tear | 9.3 | 9.8 |
| Tensile | 36.3 | 41.0 |
| % Stretch | 1.83 | 1.80 |
| T.E.A. | 28.05 | 32.78 |
| Brightness (Physical Sheets) | 46.5 | 43.1 |
| Scattering | 47.0 | 45.2 |
| Opacity (%) | 84.3 | 95.4 |
| Shive Content (%) | 1.28 | 0.40 |
| +28 Mesh (%) | 48.5 | 37.9 |

With reference to the preceding table, the Total Specific Energy for the final production of pulp using a high pressure method over the conventional method is increased by 19%. The optical quality of the sheet decreased by 3.4%. The decrease in optical quality was a result of discoloration of chromophores in the lignin due to the extended residence time at the higher pressure.

Conventionally, the primary refiner 32 can be either a single disc or a double disc design. The conventional primary refiner is operated at a speed of 1500–1800 rpm for a single disc and 1200–1500 rpm for a dual disc refiner. The range is due to the frequency of the AC power source, 60 Hz in North America and 50 Hz in most of Europe. Disc speeds over 1800 rpm in single disc designs at either operating frequency is considered high speed refining. For double disc designs, speeds over 1500 rpm at either frequency are considered high speed refining.

The following table compares conventional TMP and high speed TMP. The high speed TMP in this table was performed at 2800 rpm.

TABLE 2

EFFECT OF SPEED AT CONVENTIONAL REFINING PRESSURE

| | Conventional TMP | High Speed TMP |
|---|---|---|
| PRIMARY | | |
| RPM | 1800 | 2800 |
| Pressure (kPa) | 278 | 278 |
| Specific Energy (kWh/MT) | 974 | 876 |
| Residence Time (Seconds) | 150 | 150 |
| SECONDARY PULP | | |
| Total Specific Energy (kWh/ODMT) | 2045 | 1621 |
| Freeness (ml) | 153 | 178 |
| Bulk | 2.83 | 3.05 |

TABLE 2-continued

EFFECT OF SPEED AT CONVENTIONAL REFINING PRESSURE

| | Conventional TMP | High Speed TMP |
|---|---|---|
| Burst | 2.0 | 1.7 |
| Tear | 9.2 | 9.4 |
| Tensile | 38.3 | 40.7 |
| % Stretch | 1.83 | 1.88 |
| T.E.A. | 31.1 | 29.3 |
| Brightness (Physical Sheets) | 46.7 | 48.0 |
| Scattering | 48.6 | 49.1 |
| % Opacity | 94.5 | 94.3 |
| Shive Content (%) | 1.64 | 2.48 |
| +28 Mesh (%) | 35.5 | 35.4 |

Raising the operating speed of the refiner to 2600 rpm and leaving all other parameters the same results in pulps produced in the primary refiner with similar properties to that of the conventional TMP. The increased refiner speed results in a reduction of 15% in required Total Specific. Energy.

Combining high speed refining and high temperature preheating at a high residence time results in a commercially unacceptable refining process. There is a lose of plate gap between the discs of the primary refiner and an unacceptable loss of brightness in the pulp. Excessive thermal softening at high pressure prevents applying reasonable levels of specific energy in the primary refiner.

However, it was found that decreasing the residence time for high pressure, high intensity refining, could produce a pulp of acceptable quality and at lower energy requirements. Three examples were tested with decreasing residence times. The results are shown in the following Table 3. The results show that residence times less than 40 seconds for temperatures well above $T_g$ can avoid the poor pulp quality of high pressure, high intensity refining with a conventional high residence time. The preferred resident time of the invention is less than 30 seconds.

TABLE 3

EFFECT OF RESIDENCE TIME AT HIGH PRESSURE AND HIGH INTENSITY REFINING

| | Ex. 1 | Ex. 2 | Ex. 3 |
|---|---|---|---|
| PRIMARY | | | |
| RPM | 2800 | 2800 | 2800 |
| Residence Time (Seconds) | 120 | 24 | 13 |
| Specific Energy (kWh/MT) | 570 | 610 | 538 |
| SECONDARY PULP | | | |
| Total Specific Energy (kWh/MT) | 1817 | 1646 | 1567 |
| Freeness (ml) | 168 | 185 | 148 |
| Bulk | 2.71 | 2.89 | 2.83 |
| Burst | 1.9 | 1.8 | 2.1 |
| Tear | 9.4 | 9.4 | 9.3 |
| Tensile | 41.1 | 37.8 | 42.1 |
| % Stretch | 1.93 | 1.61 | 2.06 |
| T.E.A. | 33.8 | 28.5 | 38.5 |
| Brightness (Physical Sheets) | 43.8 | 46.6 | 48.5 |
| Scattering | 46.5 | 48.9 | 48.2 |
| Opacity | 95.4 | 84.3 | 95.1 |
| Shive Content (%) | 0.80 | 0.73 | 1.24 |
| +28 Mesh (%) | 31.5 | 33.3 | 37.7 |

In the above Table 3, using spruce chips as a test lignocellulose-containing material, the optimum residence time is thirteen seconds although the range 10–30 seconds appears to offer significant advantages. Moreover, subsequent studies have shown that at retention temperatures much higher than $T_g$, retention times as low as 5 seconds may be desirable. The result of this residence time at high pressure is sufficient thermal softening of the wood chips such that the fiber is more receptive to initial fiberization at high intensity without completely softening the fiber and coating the fiber with lignin. The majority of broken fibers in TMP pulps have been initiated during the initial defiberization of the chips in the primary refiner 32. The objective here 18 to establish an improved primary refiner pulp fingerprint at a reduced specific energy requirement. This is the RTS-TMP method of the invention.

The RTS-TMP method of the invention is compared with conventional TMP methods in Table 4.

TABLE 4

COMPARISON OF BASELINE AND RTS-TMP PULP PROPERTIES AND ENERGY REQUIREMENTS

| | Conventional TMP 1 | Conventional TMP 2 | RTS-TMP |
|---|---|---|---|
| PRIMARY | | | |
| RPM | 1800 | 1800 | 2800 |
| Pressure | 276 | 276 | 586 |
| Retention (Seconds) | 150 | 150 | 13 |
| Specific Energy (kWh/ODMT) | 1243 | 705 | 538 |
| SECONDARY | | | |
| Total Specific Energy | 2030 | 2011 | 1587 |
| Freeness (ml) | 148 | 148 | 148 |
| Bulk | 2.82 | 2.85 | 2.83 |
| Burst | 1.8 | 2.0 | 2.1 |
| Tear | 9.3 | 8.9 | 9.3 |
| Tensile | 37.1 | 38.8 | 42.1 |
| % Stretch | 1.66 | 1.93 | 2.06 |
| T.E.A. | 28.6 | 32.0 | 38.5 |
| Brightness (Physical Sheets) | 48.6 | 46.1 | 46.5 |
| Scattering | 47.0 | 52.3 | 48.2 |
| % Opacity | 93.7 | 94.8 | 95.1 |
| Shive Content | 2.18 | 1.44 | 1.24 |
| % +28 Mesh | 32.1 | 37.7 | 37.7 |

The system temperatures of conventional TMP of columns one and two, and RTS-TMP of column three are 132° C. and 166° C. respectively.

With reference to Table 4, it can be observed that the specific energy required for the base line refining 18 decreased by use of the RTS-TMP method. The results of two different runs of the conventional method are shown. The two conventional runs are at different power splits between the primary and secondary refining. The total specific energy measured in kilowatt hours per metric ton decreased from approximately 2,000 to approximately 1,500, for a decrease of 22.4%. The freeness of the pulp remained the some, even though the energy required for refining decreased.

In addition to the decreased energy requirements, certain pulp properties are improved by use of the novel RTS-TMP method of the invention over conventional TMP.

Figure 3:
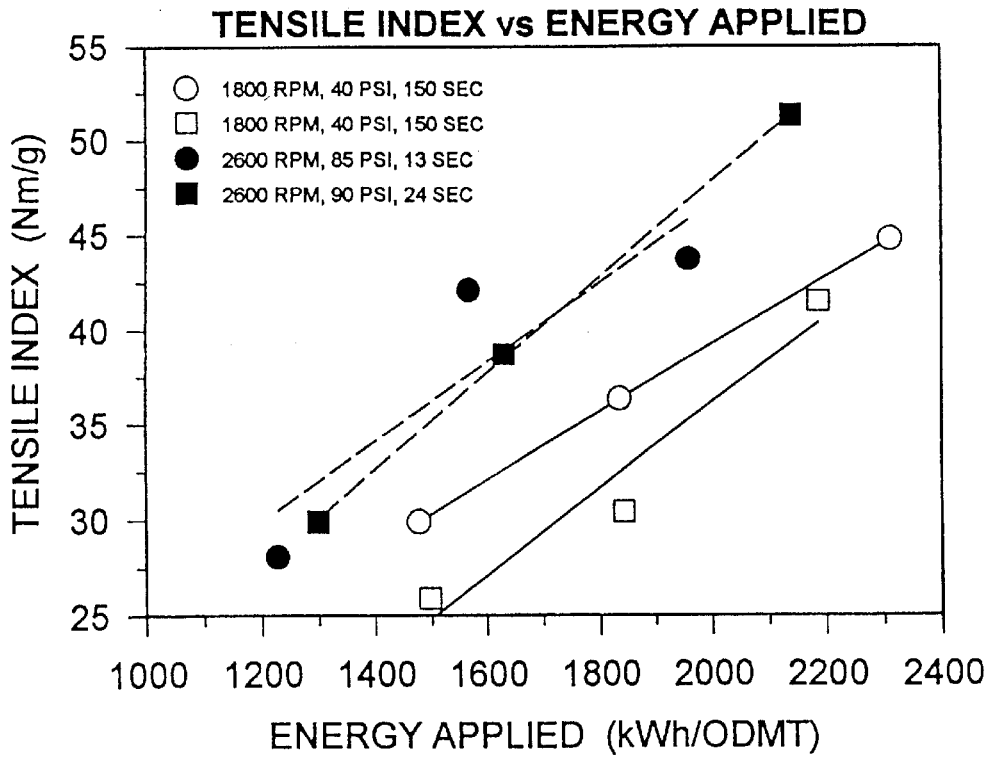
FIG. 3 is a graphical representation of the Tensile Index versus Energy Applied for pulp refined by conventional TMP methods and by the RTS-TMP method of the invention.
Figure 4:
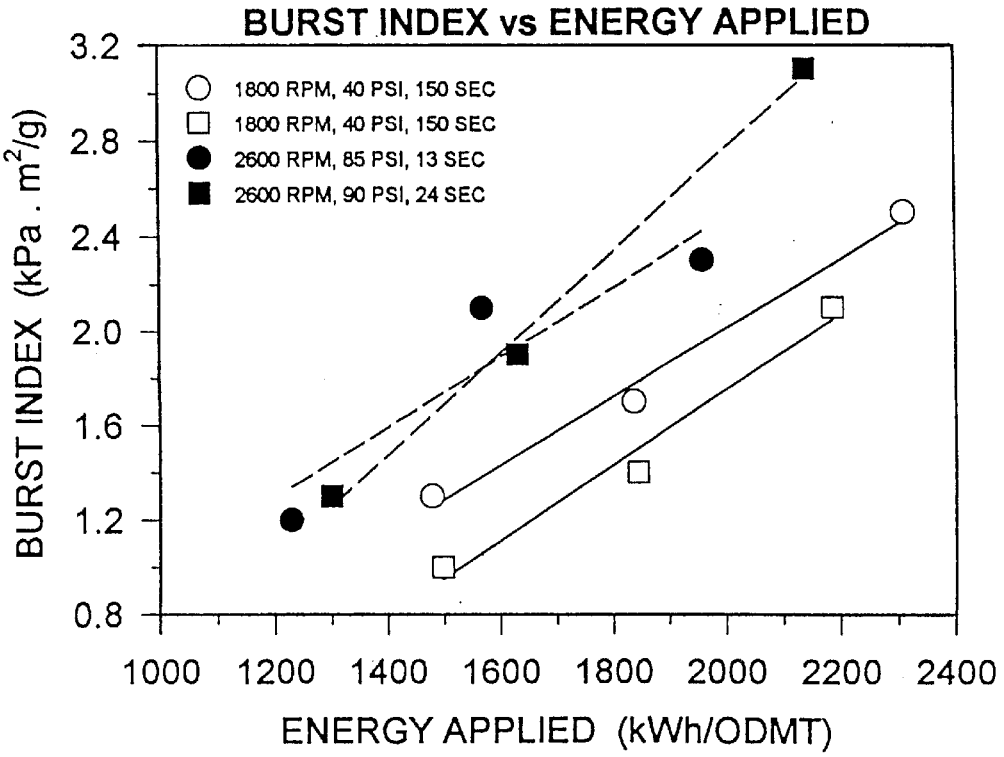
FIG. 4 is a graphical representation of the Burst Index versus Energy Applied for pulp refined by conventional TMP methods and by the RTS-TMP method of the invention.

The tensile index of the pulp measured in Newton meters per gram is increased by use of the RTS-TMP method over the conventional TMP method (FIG. 3). Compared at a similar specific energy, the RTS-TMP averaged approximately 8 Nm/g higher tensile index. Similarly, the burst index versus the energy applied is increased by use of the RTS-TMP method over the conventional TMP method of pulp refining (FIG. 4). Compared at a similar specific energy, the RTS-TMP averaged approximately 0.6 kPa.$m^2$/g higher burst index over conventional TMP.

The improved pulp quality as a result of the RTS-TMP allows greater flexibility in the type of secondary refining that can be employed. In some cases, no secondary refining will be required. The pulp from the primary refiner can be immediately processed into paper. In most cases, however, secondary refining will be required to obtain pulp of the necessary quality for the paper requirements. The primary pulp of RTS-TMP has less broken fibers end fracture zones. This improved pulp fingerprint is less prone to fiber degradation permitting energy saving high intensity refining to be used in the second stage. The improved pulp quality allows a wider variety of secondary refining. Choices of secondary refiners 44 include both low consistency refining (LCR) and high consistency refining (HCR). Low and high consistency refer to the percentage of solids to total material in the pulp. HCR is typically between 25–50% solids, and LCR is less than 10% solids. The HCR processes available include conventional HCR, high speed HCR and thermal HCR. As a result of the RTS-TMP method of the invention, energy usage is decreased 22.4%, and furthermore, additional energy savings can be realized by steam recovery at high pressure. These improvements in energy requirements are with a further benefit of improved pulp quality.

The RTS-TMP method of the invention results in improved newsprint from the refined pulp. A comparison of newsprint produced from three methods of pulp production is shown in Table 5.

TABLE 5

100% TMP NEWSPRINT PROPERTIES PRODUCED FROM BASELINE, HIGH SPEED AND RTS-TMP PULPS

| Process | Conventional TMP* | RTS-TMP** | High Speed*** |
|---|---|---|---|
| Caliper (mm) | 0.147 | 0.150 | 0.147 |
| Density (g/$cm^3$) | 0.335 | 0.339 | 0.331 |
| Brightness | 40.1 | 42.8 | 43.2 |
| Opacity | 84.2 | 85.0 | 80.9 |
| % Stretch-MD | 3.34 | 3.12 | 3.12 |
| % Stretch-CD | 3.89 | 4.15 | 4.45 |
| Tensile Index (N · m/g)-MD | 21.13 | 22.33 | 17.49 |
| Tensile Index (N · m/g)-CD | 9.43 | 9.82 | 8.48 |
| Breaking Length (m) MD | 6463 | 6831 | 5350 |
| Breaking Length (m) CD | 2888 | 3004 | 2593 |
| Burst Index (kPa · $m^2$/g) | 0.59 | 0.62 | 0.55 |
| Tear Index (mN · $m^2$/g) MD | 8.95 | 8.87 | 8.48 |
| Tear Index (mN · $m^2$/g) CD | 8.78 | 7.62 | 8.72 |

*1800 RPM, 150 seconds at 276 kPa
**2800 RPM, 13 seconds at 586 kPa
***2800 RPM, 150 seconds at 276 kPa Table 5 represents newsprint produced from secondary refiner discharge. Pulps of all three methods of primary refining were subjected to the same method of secondary refining before manufacture into newsprint. Newsprint produced from the RTS-TMP method (column 2) had no reduction in the optical properties of brightness and opacity over the newsprint made using conventional TMP (column 1). The high speed refining at conventional pressure and residence time (column 3) had the lowest bonding strength sheet properties.

The RTS results presented above were based on a residence time of 13 seconds. Reducing the residence time below this level (i.e., 5 to 12 seconds) has the effect of further reducing specific energy requirements and further increasing optical properties such as unbleached brightness and scattering coefficient. Some reduction in pulp strength properties may be observed. Increasing the residence time above this level (i.e., 14 to 30 seconds) has the effect of further increasing pulp strength properties. The specific energy requirements for this latter alternative may approach that of conventional TMP pulping.

Figure 2:
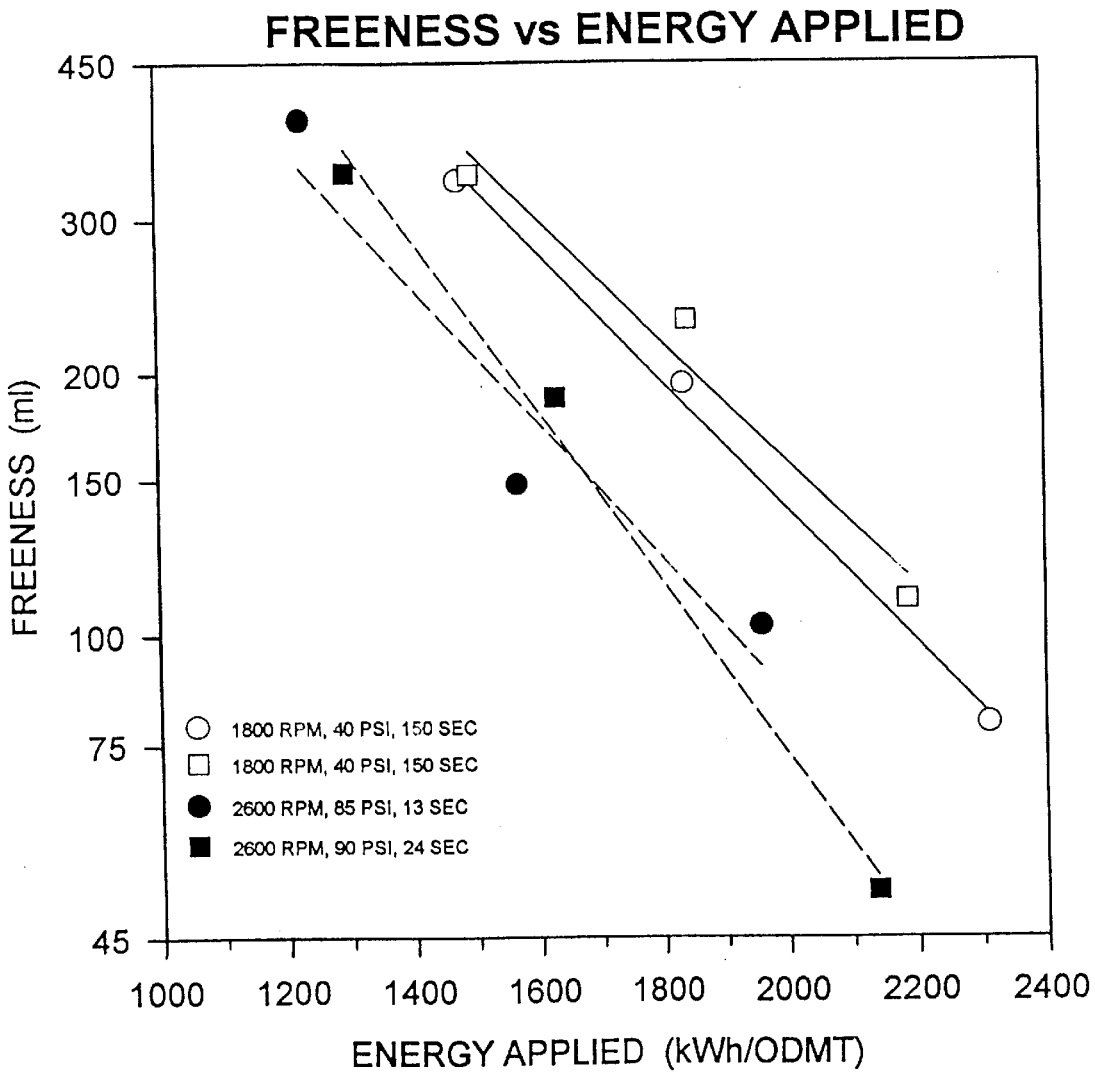
FIG. 2 is a graphical representation of the Freeness of pulp versus the Energy Applied for pulp refined by conventional TMP methods and by the RTS-TMP method of the invention.

The foregoing data provide the basis for an RTS control system in which the retention interval is adjusted according to the relative importance of particular pulp properties or process conditions. This interval is adjustable in a non-decoupled system of the type shown in FIG. 1, for example, by the speed of the discharge screw 22. In a decoupled system, the retention interval is adjusted by the speed of the variable speed transfer conveyor. With respect to Table 3 and FIGS. 2–4, one type of material (spruce chips) experienced different residence intervals of 24 or 13 seconds, before being introduced into the primary refiner, with resulting differential effects on energy, freeness and strength related properties. These data clearly show that properties such as freeness comparable to conventional refining can be achieved via RTS with a substantial reduction in energy (FIG. 2). At energies comparable to conventional refining, significantly improved strength properties can be further achieved with the RTS pulps. A retention time greater than 24 seconds on the spruce chips at RTS conditions would further increase strength properties.

Studies were conducted on another type of fiber material, radiate pine, to provide support for the conclusion that the physical pulp property/specific energy relationships could be adjusted by manipulating the residence time. Three radiata pine furnishes (top log, 17 year, 13 year) were refined in a baseline, i.e., conventional manner, and within the RTS window of the present invention. The pre-steam retention at system pressure for the RTS process was 22 seconds. The refining system pressure for the baseline and RTS runs were approximately 287 kPa and 610 kPa, respectively. Table 6 compares the physical pulp properties and specific energy requirements. The results show an increase in burst index (+6.7% to 26.0%), tensile index (+7.6% to 18.0%), % stretch (+1.6% to 8.1%), T.E.A. (+17.5% to +24.2%) and tear index (+7.6% to +18.0%) with the RTS-TMP pulps relative to the baseline pulps. The bulk of the RTS pulps was lower than the baseline TMP pulps, suggesting the level of thermal softening was higher than typically obtained. The specific energy requirements between the baseline and RTS-TMP pulps were similar, also indicating a higher level of thermal softening. The RTS residence interval, however, remained low enough to prevent loss of brightness. The level of shive reduction ranged from 45% to 88%.

TABLE 6

COMPARISON OF BASELINE AND RTS-YMP PULP PROPERTIES AND ENERGY REQUIREMENTS

| | FURNISH | | | | | |
|---|---|---|---|---|---|---|
| | TOPLOG | | 17 YEAR | | 13 YEAR | |
| | BASELINE | RTS | BASELINE | RTS | BASELINE | RTS |
| SPEC. ENERGY | 2083 | 2129 | 2381 | 2383 | 2187 | 2128 |
| FREENESS (ml) | 129 | 153 | 168 | 102 | 343 | 306 |
| BULK | 3.17 | 2.94 | 2.92 | 2.84 | 3.80 | 3.38 |
| BURST | 1.8 | 1.8 | 1.8 | 1.8 | 1.2 | 1.5 |
| TEAR | 7.0 | 8.8 | 7.8 | 8.2 | 10.5 | 11.3 |
| TENSILE | 28.0 | 33.2 | 32.4 | 38.4 | 28.2 | 31.8 |
| % STRETCH | 1.49 | 1.89 | 1.74 | 1.88 | 1.90 | 1.93 |
| T.E.A. | 18.42 | 22.56 | 24.31 | 26.66 | 20.95 | 26.01 |
| ISO BRIGHTNESS | 84.3 | 84.2 | 55.1 | 55.0 | 48.4 | 55.2 |
| SCATTERING COEFFICIENT | 42.8 | 42.8 | 44.8 | 43.4 | 42.2 | 40.0 |
| OPACITY | 88.3 | 88.8 | 88.9 | 88.1 | 80.3 | 87.8 |
| SHIVE CONTENT | 0.22 | 0.12 | 0.50 | 0.08 | 1.32 | 0.20 |
| % +28 MESH | 33.3 | 33.8 | 27.8 | 33.1 | 40.0 | 37.4 |
| WEIGHTED AVER. FIBER LENGTH (mm) | 2.21 | 2.18 | 1.87 | 2.10 | 2.15 | 2.04 |
| WIDTH INDEX | 12.11 | 11.72 | 9.90 | 10.07 | 11.87 | 9.57 |

Additional RTS runs at a reduced retention (12 seconds) were completed on chips from a separate series of radiata pine toplog. Table 7 compares the physical pulp properties and specific energy requirements. A reduction in specific energy of 223 kWh/ODMT was observed with the RTS pulp relative to the baseline. Overall strength properties were comparable between both pulps. The RTS pulp had a higher scattering coefficient, brightness and lower shive content.

The results indicate the importance of retention on pulp quality and specific energy. The importance or sensitivity of the retention interval is a function of the type of wood species utilized. A pressurized variable speed transfer screw such as at 22 in FIG. 1, can be used to adjust RTS pulp properties i.e., low residence (to minimize energy requirements, improve optical properties), high residence (to maximize strength properties). The desired retention interval could be further adjusted based on mill requirements (i.e., energy costs, chemical pulp costs, paper quality).

TABLE 7

COMPARISON OF BASELINE AND RTS-TMP PULP PROPERTIES AND ENERGY REQUIREMENTS

| | BASELINE | RTS |
|---|---|---|
| SPECIFIC ENERGY (kWh/ODMT) | 2248 | 2023 |
| FREENESS (ml) | 204* | 204 |
| BULK | 3.15 | 3.18 |
| BURST | 1.7 | 1.7 |
| TEAR | 12.4 | 12.8 |
| TENSILE | 37.2 | 36.8 |
| ISO BRIGHTNESS | 47.4 | 49.2 |
| SCATTERING COEFFICIENT | 35.6 | 37.7 |
| % OPACITY | 91.1 | 91.2 |
| SHIVE CONTENT (%) | 0.48 | 0.22 |
| % +28 MESH | 46.2 | 47.2 |

*INTERPOLATED AT 204 ml

Several pulps produced from the toplog, 17 year and 13 year furnishes were bench bleached with an alkaline peroxide bleach liquor. The chemical charges applied included 1% $H_2O_2$, 1% NaOH, 1.5% sodium silicate, 0.15% epsom salt, and 0.1% DTPA. The pulps were pro-treated with 0.15% DTPA prior to bleaching at 70° C. for two hours. Table 8 lists the results for each bench bleach.

refining run of considerable duration, typically exceeding 24 hours. Throughout the first refining run, the RTS temperature of the first type of woodchip is maintained well above the glass transition temperature of the first type of fiber, for a first preset time interval. The RTS conditions for top log radiate pine furnish as shown in Table 6, corresponding to a retention interval of 22 seconds at system pressure, could be expected to produce the properties indicated in that table. This represents a relatively long retention interval, which maximizes strength properties.

The same refining system in the same plant, can later receive a continuous supply of the same type of fiber, but with the process adjusted to maximize the optical properties and/or minimize energy requirements. For radiate pine, the conditions indicated in Table 7 could be performed, with a reduced retention interval of 12 seconds.

Thus, for the same type of fiber material, one can operate within the overall RTS window, while using the residence interval as the control variable. The most useful range for the residence interval spans about 5 to about 30 seconds. An interval difference of at least 2 seconds and preferably at least about 4–5 seconds, can have a measurable impact on important pulp properties such as energy consumption, optical properties and strength properties. A difference of about 10 seconds produces impressive variations in properties, in general, a relatively low retention time would be under 15 seconds, whereas a relatively high retention time would be over 15 seconds.

TABLE 8

UNBLEACHED AND BLEACHED TMP PULP BRIGHTNESS

| | PROCESS | | | | | | | |
|---|---|---|---|---|---|---|---|---|
| | TMP | TMP | TMP | RTS | RTS | RTS | RTS | RTS |
| | FURNISH | | | | | | | |
| | TOPLOG | 17 YR | 13 YR | TOPLOG | 17 YR | 17 YR | 13 YR | 13 YR |
| UNBLEACHED BRIGHTNESS (°ISO) | 54.3 | 55.1 | 49.4 | 84.2 | 55.0 | 56.0 | 54.5 | 58.2 |
| BLEACHED BRIGHTNESS (°ISO) | 65.3 | 66.7 | 87.9 | 88.2 | 66.5 | 70.2 | 68.7 | 89.3 |
| BRIGHTNESS INCREASE | 11.0 | 11.6 | 8.5 | 14.0 | 12.8 | 14.2 | 14.2 | 14.1 |
| FREENESS (ml) | 128 | 168 | 343 | 133 | 244 | 192 | 347 | 305 |

The RTS pulps bleached to approximately 3° ISO higher brightness at an equivalent chemical application. One explanation is that the polymerization of chromophoric compounds (darkening reactions) are reduced to some extent during RTS pulping conditions. This may be of benefit for production of pulps at higher brightness levels than newsprint.

Those data support the conclusion, that reducing the retention interval of the RTS pulps reduces specific energy requirements and increases optical properties relative to the baseline pulp. Increasing the retention interval increases pulp strength properties at a similar specific energy relative to the baseline pulp. A lower shive content was observed with the RTS pulps at low and high levels of retention. Therefore, the particular conditions within the RTS window, can be selected depending on the relative importance of, e.g., optical properties of the pulp, strength properties of the pulp, and specific energy. For example, in a particular disc refining system in a particular mill, a first type of fiber in the form of a first type of woodchip, e.g., top log radiate pine, is continuously supplied to the refining system for a first It should also be appreciated that for a given refining system in a given refining mill, different fiber types can be processed under different conditions within the overall RTS window. For example, a first type of wood chip can be continuously refined in a first run, in which the temperature according to the invention is maintained above the glass transition temperature for a first preset retention interval, selected to optimize energy consumption. Upon completion of the first run, or at any time thereafter, a second type of fiber in the form of a second type of wood chip can be continuously supplied for a second refining run, wherein the temperature of the second type of woodchip is maintained above the glass transition temperature of the second type of fiber, for a second preset retention interval, which is different from the first retention interval. The difference in the retention interval for the second run, could arise from any one or more of (a) empirical data indicating that, to achieve the substantially same combination of energy efficiency, optical properties and strength properties of the pulp in the first run, the different material in the second run requires slightly greater or lesser retention time; (b) that the end use for the pulp in the second run requires maximization of optical properties, without regard to energy consumption and/or strength properties; (c) the end use for the pulp of the second run requires maximizing strength properties, without regard to energy and/or optical properties, etc. In a given refining system of a given mill, implementation of a control system according to the present invention would generally result in adjustment of the retention interval from a first run to a subsequent second run using different fiber material, by at least 5 seconds, and in many instances, by at least 10 seconds.

In general, a balanced optimization of energy consumption, strength properties and optical properties would require a retention interval in the range of 13–15 seconds when averaged over a wide range of materials, but the equipment would be capable of achieving a retention interval, from about 6 to about 30 seconds, especially from about 10 to about 25 seconds.

The heating and maintenance at the desired temperature for the desired retention interval, is preferably achieved with the backflowing of steam from a pressurized refiner, in a pressurized variable speed transfer conveyor screw. An example of such apparatus is Model 470 pressurized Conveyor, available from Andritz Sprout-Bauer, Inc., Muncy, Pa., U.S.A. This arrangement for presetting the retention interval could be responsive to on-line measurement of e.g., energy rate, freeness, etc.

Further developments have confirmed the important influence of refiner speed. Although intensity and speed are closely related, (see e.g., the Miles article cited in the Background), the benefits of utilizing speed as a distinct process condition, are quite dramatic and surprising. The relationship of refining intensity and pulp quality is discussed in "Refining intensity and Pulp Quality in High Consistency Refining", K. B. Miles, *Paper and Timber,* 72 (1990):5.

Calculations have been derived from the Miles articles, to estimate the refining intensity (e), or average energy per bar impact. As is well known, refiner discs have a pattern of alternating bars and grooves. The equations were developed to better explain the effect of refining parameters on observed pulp quality and specific energy requirements.

$$\text{refining intensity} = e = \frac{E}{n}$$

$$\text{number of impacts} = n = Nhw\frac{r1 + r2}{2}\tau$$

$$\text{residence time in refiner} = \tau = \frac{\mu_r}{\mu_t}\frac{aEc_1L\left[\ln\frac{r2}{r1} - \frac{1}{2}\ln\left(\frac{L - c_1E}{L}\right)\right]}{w^3(L(r2^2 - r1^2) + c_1Er1^2)}$$

E=Specific Energy

Figure 5:
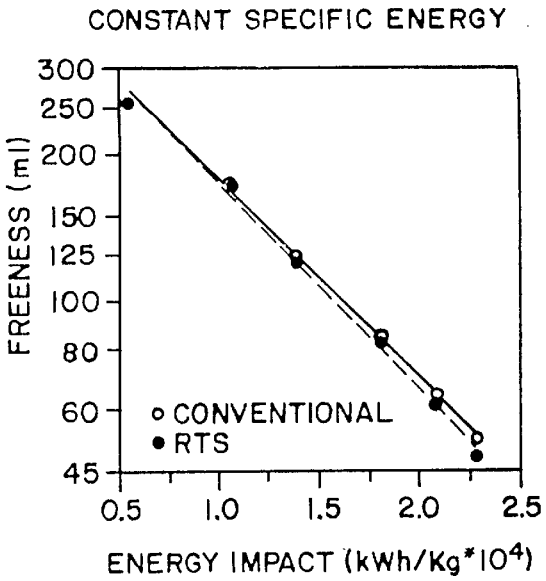
FIGS. 5–8 are graphs which compare various characteristics of primary pulp produced by conventional TMP and with the present invention, as a function of energy applied per bar impact of the rotating disc.
Figure 6:
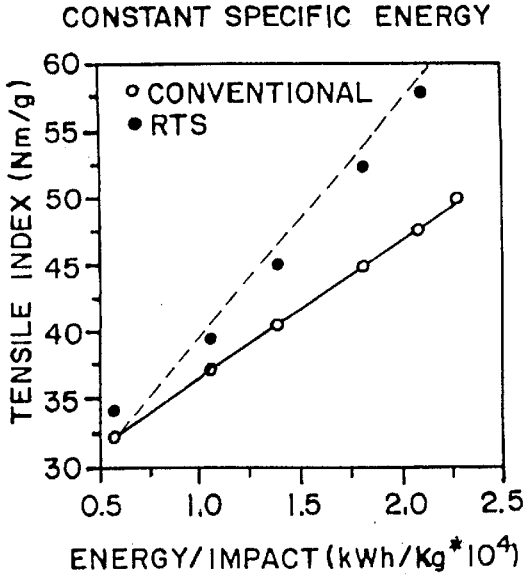
Figure 7:
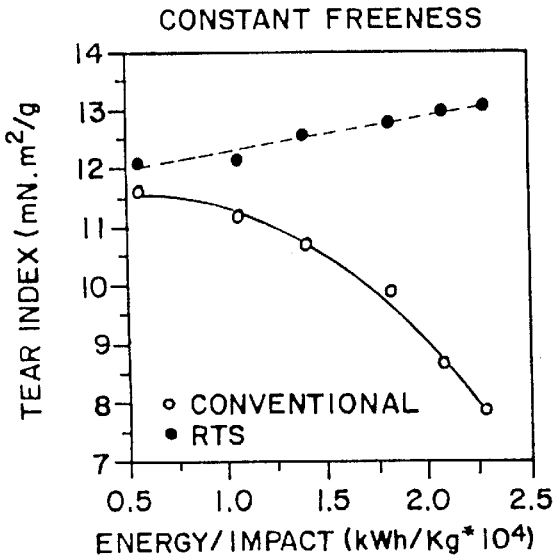
Figure 8:
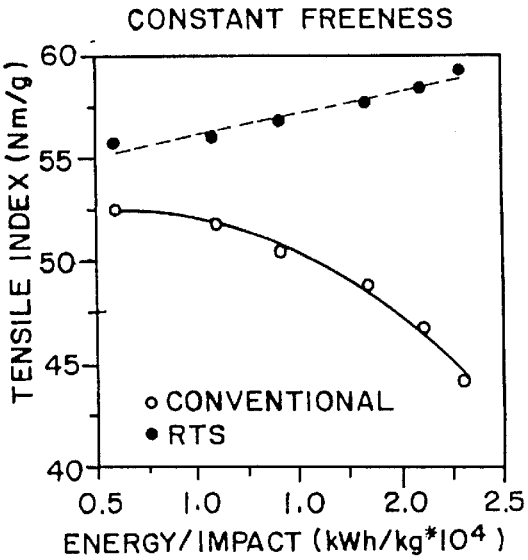

N=Number of Bars per unit length of arc h=1 for single disc refiner, 2 for double disc refiner w=Speed of rotation r1, r2=inlet and outlet radii of refining zone a=4 for single disc; 2 for double disc $\mu r$, $\mu t$=Radial and tangential friction coefficients between the pulp and the discs ci=inlet consistency L=Latent heat of steam Empirical relationships between the refining intensity and pulp quality have been developed from studies using a variable speed single disc refiner having a disc diameter of about 36 inches (91 cm). FIGS. 5–8 show TMP pulp quality as a function of intensity (energy/bar impact). The open circle data points show relationships between quality and intensity for conventional TMP processes. In FIG. 5 at a constant specific energy, the freeness decreases with energy per bar impact. In FIG. 6 at a constant specific energy, the tensile index increases with energy per bar impact. High intensity refining reduces the total specific energy to achieve a given pulp quality. In FIG. 7 at a constant freeness, the tear index decreases with increasing intensity. In FIG. 8 at a constant freeness, the tensile index decreases with increasing intensity.

The data for TMP in these figures assume the intensity can be increased by any or a combination of the following parameters.

1) increase refiner disc speed;
2) Decrease refining consistency;
3) Reduce bar density of refiner plates;
4) Reduce differential pressure from feed to accepts of refiner ($\Delta P$).

Figure 9:
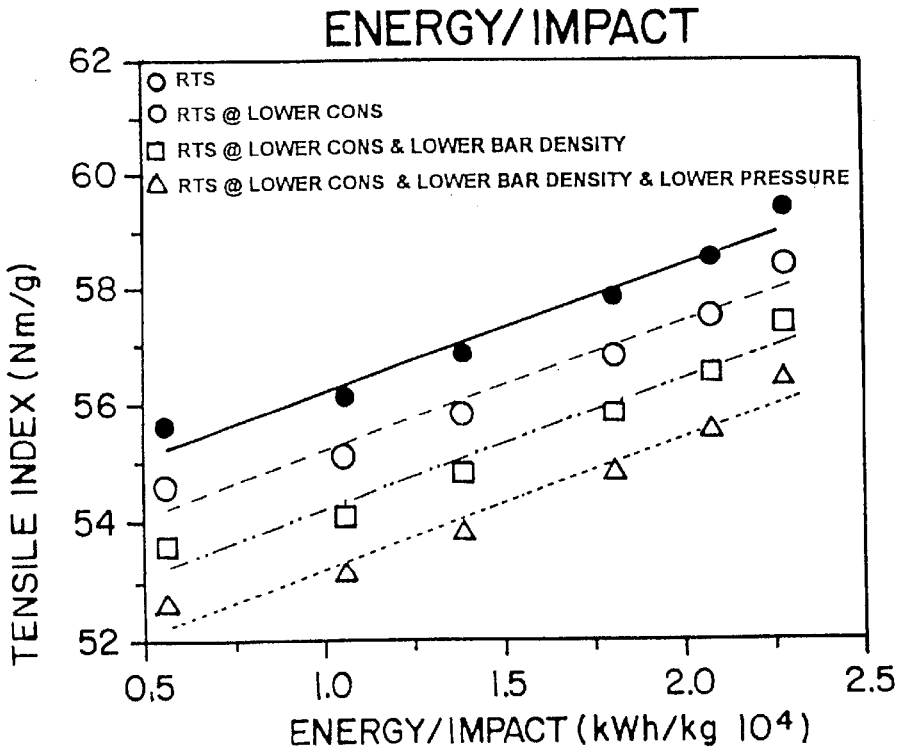
FIG. 9 is a graph which shows the dominant influence of speed as the intensity variable which provides the improved quality at a given high intensity, available from the present invention, relative to conventional TMP.

In accordance with the invention, the RTS mechanism changes the impact or effect of refining speed on pulp quality at a given freeness. The RTS data points appear as solid circles on FIGS. 5–8. Pulp quality is actually improved at levels of intensity higher than about $0.5*10^{-4}$ kWh/kg per bar impact, especially above $1.0*10^{-4}$ kWh/kg per bar impact, when operating in the recommended RTS window, The conventional understanding of the effect of refiner speed on pulp strength properties at a given freeness is actually reversed in the RTS window. The remaining variables that could increase refining intensity (consistency, plate pattern, differential pressure) continue to negatively influence pulp strength properties at a given freeness. FIG. 9 indicates the influence of these variables on RTS pulp quality. A specific quantitative range of optimal refining intensity values could differ significantly for two installations based on the type of wood furnish, plate pattern, solids content of wood furnish and other process parameters. The RTS process improves quality at a given freeness due to the mechanism of how energy is transferred to the fiber by the combination of high speed and the elevated thermal temperature of the fiber walls. An optimal set of high speed conditions and thermal conditions (i.e., RTS window) exists for any given size refiner.

The specific energy (E) for the primary refiner according to the invention, would be at least 400 kWh/ODMT, typically in the range of 400–800 kWh/ODMT, but values above 800 kWh/ODMT, e.g.; above about 1200 kWh/ODMT, have been achieved with good results.

According to the data corresponding to the invention, in FIG. 5 at a constant specific energy, the freeness decreases with energy per bar impact. In FIG. 6 at a constant specific energy, the RTS process further increases tensile index at a given intensity, in FIG. 7 at a constant freeness, the RTS process increases the tear index at a given intensity. In FIG. 8 at a constant freeness, the RTS conditions increases the tensile index at a given intensity.

The parameter window has been Identified in which the mechanism of energy transfer per bar impact at high speed improves both fiber fibrillation and unbleached brightness at a given specific energy application. The interactive benefits of operating in this window have not been identified or established in previous research or mill installations. Surprisingly, the invention improves pulp quality as intensity e increases due to increases in speed of rotation. The pulp quality, including strength properties and optical properties, are improved beyond that produced with available TMP technologies to date.

This can be explained at least in part. The fiber wall layers are heated to temperatures above that used in modern practice at pulp and/or paper installations to produce TMP pulp for mechanical printing grades including newsprint, LWC (lightweight coated) and SC (supercalendered). This permits improved fiber wall delamination and surface peeling at each bar impact applied in the refining zone at high speed. At conventional levels of fiber softening, a higher level of fiber fracturing is observed at a given freeness, since the fiber walls are less resilient to the higher energy per bar impact observed at higher refiner disc speeds. The mechanism of energy transfer or energy per bar impact (intensity) is improved in this window. Operating at a similar intensity (energy per bar impact) outside of the defined R-T-S window will result in a reduction in pulp quality.

Figure 10:
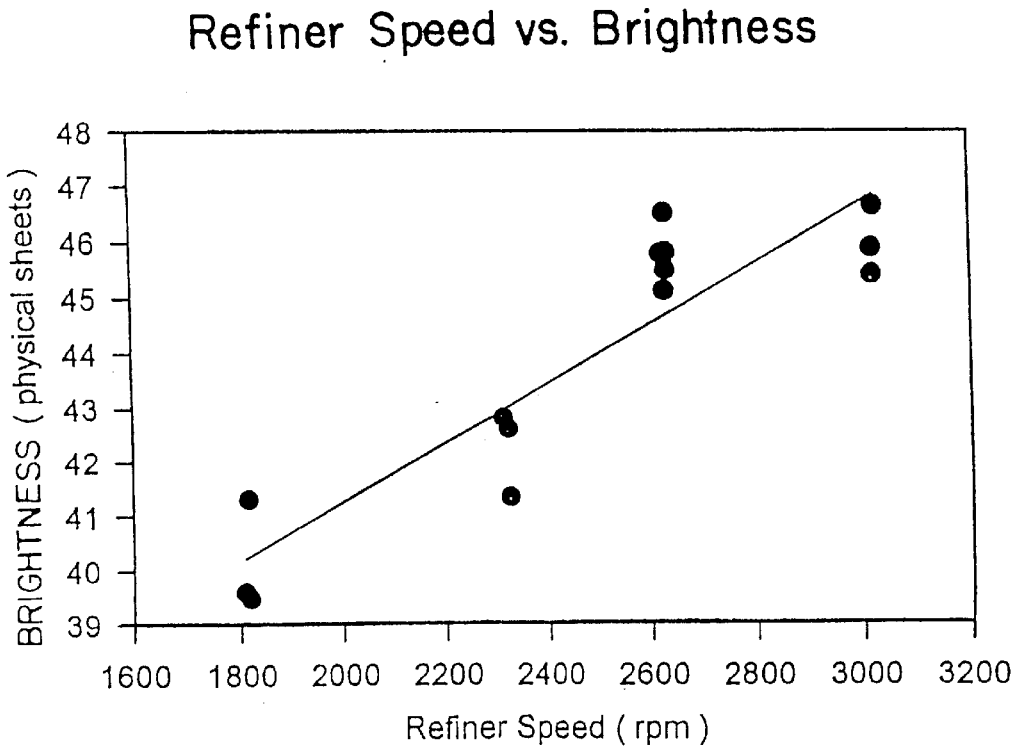
FIG. 10 shows the effect of refiner speed on the optical qualities of brightness.

The level of darkening reactions of complex color bearing groups in the lignin are similar or less than that observed by conventional TMP pulping methods. Two explanations may define the observations on optical properties. The unbleached TMP pulp brightness increases and hence the level of thermal darkening reactions decreases with an increase in refiner disc speed (see FIG. 10). The figure demonstrates an increase in unbleached brightness with an increase in refiner disc speed. The furnish for this study was a dark West coast furnish consisting of fir, hemlock and pine. Each of the values on FIG. 10 are interpolated from curves at a freeness of 100 ml. The refiner speed on the horizontal axis is the average speed of the primary refiner for each run (i.e., the speed of the refiner is controlled by a variable frequency drive. Brightness was recorded from physical handsheets using an Elrepho Brightness meter. This phenomena is observed during high speed operation at conventional or elevated temperature conditions. The explanation is found in that the residence time between the plates and hence the residence time at the maximum pressure (or temperature) peak, is significantly reduced at high speed, reducing the level of darkening reactions. The effect of refining speed on retention time between plates is evident in the quantitative expressions set forth above.

The bleachability of RTS pulps, has also demonstrated an improvement compared to conventional TMP pulps, again linked to a reduced level of darkening reactions (polymerization of color bearing compounds) during pulping. The tables below summarize brightness response of a Northeastern furnish using RTS and conventional TMP processes at two levels of hydrogen peroxide application.

TABLE 9

BLEACHING RESULTS AT PEROXIDE APPLICATION OF 1.0%

| PROCESS | RTS | RTS | RTS | CONV. | CONV. | CONV. |
|---|---|---|---|---|---|---|
| % H2O2 | 1.0 | 1.0 | 1.0 | 1.0 | 1.0 | 1.0 |
| % NaOH | 0.7 | 1.0 | 1.3 | 0.7 | 1.0 | 1.3 |
| Brightness Gain (ISO) | 7.5 | 9.5 | 9.9 | 7.4 | 7.8 | 5.4 |
| H2O2 Residual (% of applied H2O2) | 30 | 29 | 23 | 24 | 11 | 3 |

Bleaching conditions: two hours at 60° C.

Bleaching consistency: 16% (feed pulp consistency = 20%)

Optimized Brightness Gain (°ISO) = 8.8 (RTS) - 7.8 (conventional) = 2.3 °ISO

TABLE 10

BLEACHING RESULTS AT PEROXIDE APPLICATION OF 2.5%

| PROCESS | RTS | RTS | RTS | CONV. | CONV. | CONV. |
|---|---|---|---|---|---|---|
| % H2O2 | 2.5 | 2.5 | 2.5 | 2.5 | 2.5 | 2.5 |
| % NaOH | 2.0 | 2.5 | 3.0 | 2.0 | 2.5 | 3.0 |
| Brightness Gain (ISO) | 15.3 | 15.8 | 16.6 | 14.4 | 14.1 | 13.0 |
| H2O2 Residual (% of applied H2O2) | 47 | 33 | 34 | 20 | 12 | 8 |

Bleaching conditions: two hours at 60° C.

Bleaching consistency: 16% (feed pulp consistency = 20%)

Optimized Brightness Gain (°ISO) = 16.6 (RTS) - 14.4 (conventional) = 2.2 °ISO

Figure 11:
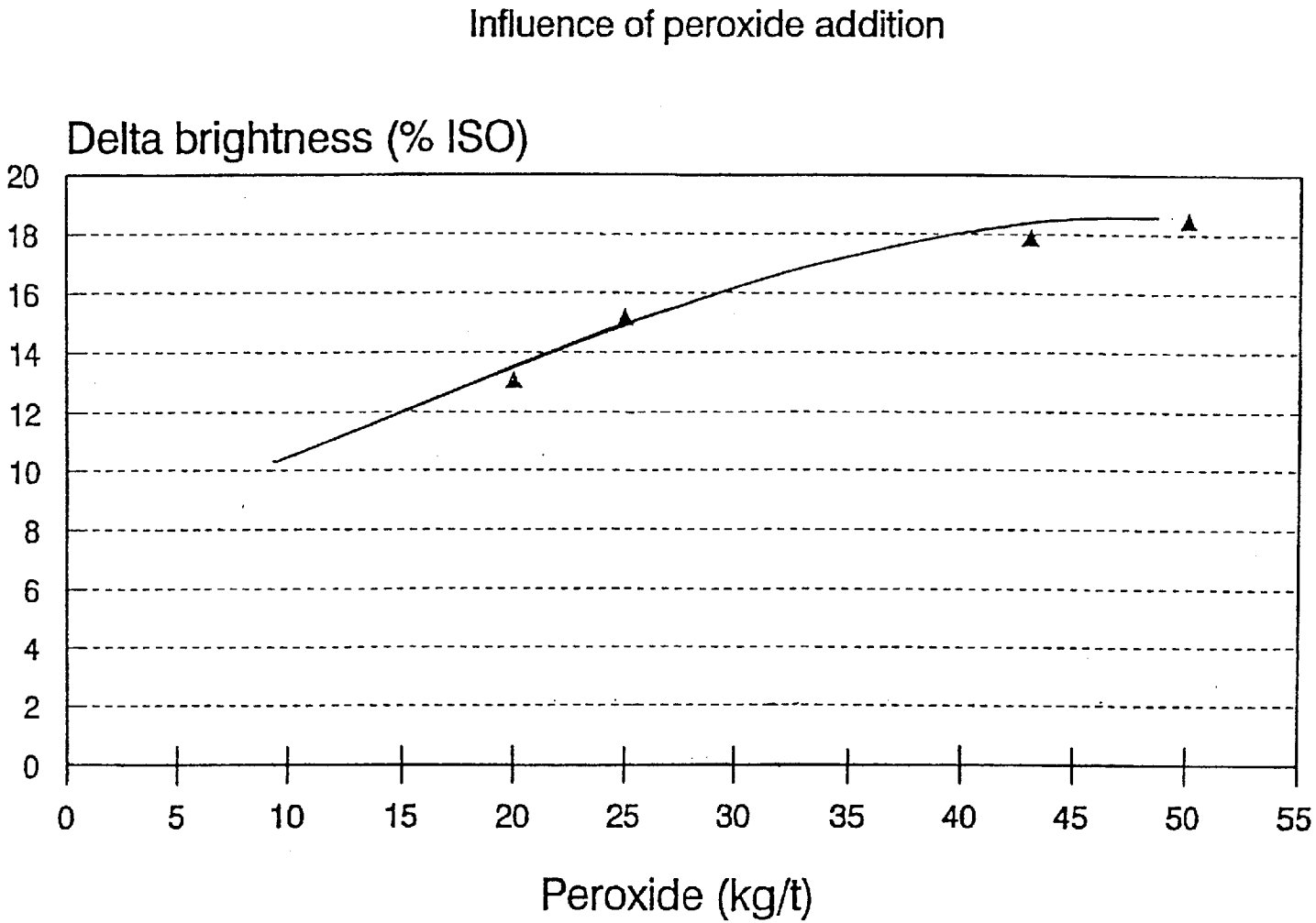
FIGS. 11 and 12 are representative graphs showing empirical evidence of improved bleachability (delta brightness) resulting from use of the present inventions
Figure 12:
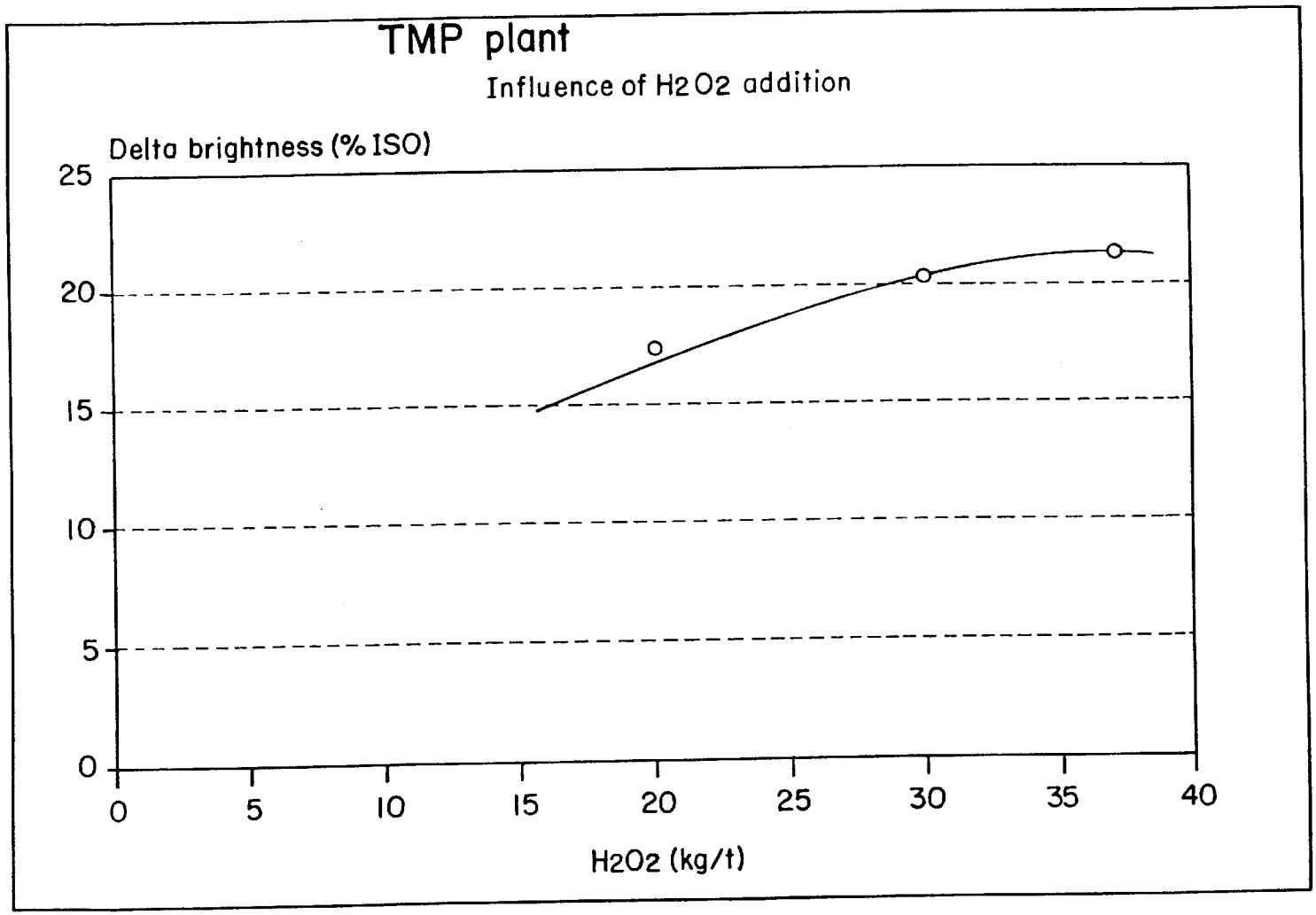

The improved brightness response has also been demonstrated in mill operation (see FIGS. 11 and 12) at a given peroxide charge compared to TMP mills using a similar spruce furnish. The improvement is expressed as "delta brightness", in per cent increase in ISO brightness.

Furthermore, during the steaming of wood chips, the conduction of heat initiates through the available voids or lumena. The heat must therefore conduct through the fiber wall layers (S3→S2→S1→P) before heating the middle lamella, which contains the highest concentration of lignin. The lignin in the middle lamella also contains the most complex color bearing structures. By this method of heat transfer and at low levels of retention, the fiber walls are heat shocked to higher temperatures (permitting improved fibrillation at high speed); however, the level of thermal darkening reactions associated with lignin in the middle lamella are less than or comparable to conventional TMP pulping.

The level of thermal softening of lignin in the middle lamella is equal or less than that observed from conventional TMP pulping methods. This is verified by a similar to higher unbleached pulp brightness with the RTS pulp compared to the conventional TMP pulps. This is also supported by a high degree of fiber delamination and peeling at the secondary wall layers as opposed to separation at the middle lamella.

RTS and conventional TMP pulps were produced from spruce chips supplied from a newsprint producer in Quebec. The table below (Table 11) illustrates the length weighted average fiber length, width index, coarseness, and handsheet bulk of the +14 mesh and +28 mesh long fiber fractions (from a Baver McNett fractionator) from both conventional (B/L) and RTS TMP pulps. The freeness values at the top of the table represent the total pulp from which the long fiber fractions were fractionated out. The results indicate a significant reduction in the coarseness and bulk of the RTS long fiber fractions. This is of particular benefit to value added paper (i.e., SC or LWC producers) which produce paper at low caliper and high smoothness requirements.

TABLE 11

Long Fiber Coarseness Results
BASELINE & RTS SPRUCE TMP

| PROCESS | B/L | B/L | RTS | RTS | RTS |
|---|---|---|---|---|---|
| Sample ID | A6 | A7 | A4 | A18 | A5 |
| Freeness (ml) | 125 | 90 | 119 | 113 | 80 |
| Fiberscan (mm) | | | | | |
| LW Avg +14 | 3.41 | 3.36 | 3.16 | 3.30 | 3.33 |
| LW Avg +28 | 2.40 | 2.28 | 2.40 | 2.38 | 2.32 |
| WI +14 | 31.19 | 28.22 | 25.74 | 25.11 | 23.84 |
| WI +28 | 20.63 | 17.99 | 17.83 | 16.99 | 16.89 |

TABLE 11-continued

| Long Fiber Coarseness Results BASELINE & RTS SPRUCE TMP | | | | | |
|---|---|---|---|---|---|
| PROCESS | B/L | B/L | RTS | RTS | RTS |
| Coarseness* (mg/ml) | | | | | |
| +28 | 0.301 | 0.288 | 0.198 | 0.195 | 0.192 |
| Bulk ($cm^3/g$) | | | | | |
| +14 | 5.13 | 4.13 | 3.79 | 3.63 | 3.48 |
| +28 | 4.12 | 4.00 | 3.63 | 3.56 | 3.24 |

LW Avg = Length Weighted Average Length
WI = Width Index
*Note: +14 coarseness not available.

While a preferred embodiment of the foregoing method of the invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A method for producing pulp from lignocellulose containing fiber material, by a refining process which includes at least a primary step performed by a high consistency single or double rotating disc refiner, wherein the improvement comprises:

preheating the fiber material by maintaining the fiber material at least about 20° C. above the glass transition temperature of the lignin of the fiber material in an environment of saturated steam at a pressure in the range of 75–95 psi, for a period of time less than about 10 seconds during which period the material is conveyed toward and introduced into the refiner and then immediately;

refining the preheated fiber material in the primary refining step with high-speed disc rotation in a single disc refiner of at least 2000 rpm or a double disc rotation of at least 1800 rpm, which imparts specific energy of at least 400 kWh/ODMT to the fiber material; and feeding the fiber material refined in the primary disc refiner through a blow line at a temperature higher than the glass transition temperature of the lignin to perform a secondary step of defibrating in a second high consistency single or double rotating disc refiner having a rotation speed of at least 2000 rpm or 1800 rpm respectively.

2. A method for producing pulp having first quality characteristics during a first refining run on a first quantity of a particular type of lignocellulose-containing feed material, and thereafter producing pulp having second, different quality characteristics during a second refining run on a second quantity of the same particular type of lignocellulose-containing feed material, comprising:

supplying a feed flow of said first quantity of said material to a preheater;

preheating the flow of said first quantity of material by maintaining the material above the glass transition temperature of the lignin of the material in an environment of saturated steam at a pressure in the range of 75–95 psi, for a first preset time interval of less than about 30 seconds during which first time interval the material is conveyed toward and introduced into a high consistency primary disc refiner and then immediately;

refining the flow of said first quantity of preheated material in a primary disc refiner having either a single rotating disc with a speed of at least 2000 rpm or double rotating discs with a speed of at least 1800 rpm which imparts specific energy of at least 400 kWh/ODMT to the material to produce pulp having said first quality characteristics;

after said first refining run, supplying a feed flow of said second quantity of said material to said preheater;

preheating the flow of said second quantity of material by maintaining the material above the glass transition temperature of the lignin of the material in an environment of saturated steam at a pressure in the range of 75–95 psi, for a second preset time interval less than about 30 seconds but differing by at least about 2 seconds from the first time preset interval, during which second time interval the material is conveyed toward and introduced into the same primary disc refiner of the first refining run and then immediately;

refining the flow of said second quantity of preheated material in said same primary disc refiner with a high speed disc rotation of at least 2000 rpm if said primary refiner is a single disc refiner or at least 1800 rpm if said primary refiner is a double disc refiner, which imparts specific energy of at least 400 kWh/ODMT to the material, to produce pulp having said second quality characteristics.

3. The method of claim 2, wherein said second preset time interval differs from said first preset time interval, by at least about 10 seconds.

4. The method of claim 3, wherein said first preset time interval is less than 15 seconds, and said second preset time interval is greater than 15 seconds.

5. The method of claim 2, wherein the first and second preset time intervals are each less than about 15 seconds.

6. The method of claim 2, wherein the first and second preset time intervals differ by at least about 4 seconds.

7. A method for producing pulp during a first refining run lasting at least 24 hours on a first quantity of a particular type of lignocellulose-containing feed material, and thereafter producing pulp during a second refining run lasting at least 24 hours on a second quantity of a different type of lignocellulose-containing feed material, comprising:

continuously supplying a feed flow of said first quantity of said material to a preheater;

preheating the flow of said first quantity of material by maintaining the material above the glass transition temperature of the lignin of the material in an environment of saturated steam at a pressure in the range of 75–95 psi, for a first preset time interval of less than about 30 seconds during which first time interval the material is conveyed toward and introduced into a high consistency primary disc refiner and then immediately;

refining the flow of said first quantity of preheated material in the primary refiner having either a single rotating disc with a speed of at least 2000 rpm or double rotating discs with a speed of at least 1800 rpm which imparts specific energy of at least 400 kWh/ODMT to the material to produce pulp;

after said first refining run, supplying a feed flow of said second quantity of a different type of wood chip material to said preheater;

preheating the flow of said second quantity of material by maintaining the material above the glass transition temperature of the lignin of the material in an environment of saturated steam at a pressure in the range of 75–95 psi, for a second preset time interval of less than about 30 seconds but differing by at least about 5 seconds from the first preset time interval, during which second time interval the material is conveyed toward and introduced into the same primary disc refiner of the first refining run and then immediately;

refining the flow of said second quantity of preheated material in said same primary disc refiner with a high speed disc rotation of at least 2000 rpm if said primary refiner is a single disc refiner or at least 1800 rpm if said primary refiner is a double disc refiner, which imparts specific energy of at least 400 kWh/ODMT to the material.

8. The method of claim 7, wherein the difference in said Preset time interval, is at least about 10 seconds.

9. The method of claim 8, wherein each of said preset time interval is between about 10 and 25 seconds in duration.

10. The method of claim 7, wherein at least one preset time interval is less than about 15 seconds.

11. The method of claim 7, wherein the preheater includes a pressurized variable speed transfer screw; and the first and second preset time intervals are controlled by controlling the speed of said transfer screw.

12. The method of claim 11, wherein said second controlled time interval differs from said first controlled time, by at least about 5 seconds.

13. The method of claim 11, wherein the controlled time interval by the transfer screw during said first refining run is less than about 15 seconds.

14. The method of claim 11 wherein each time interval is less than about 15 seconds.

15. The method of claim 14, wherein said second run is at least 24 hours and said second time interval differs from said first time interval, by at least about 2 seconds.

* * * * *